187-20 AU 311 EX

10/22/85 OR 4,548,297

United States Patent [19]

Salmon et al.

[11] Patent Number: 4,548,297

[45] Date of Patent: Oct. 22, 1985

[54] ELEVATOR CAR VIBRATION CONTROL WITH FRICTION DAMPER

[75] Inventors: John K. Salmon, South Windsor; Young S. Yoo, Avon, both of Conn.

[73] Assignee: Otis Elevator Company, Farmington, Conn.

[21] Appl. No.: 550,277

[22] Filed: Nov. 9, 1983

[51] Int. Cl.[4] ..... B66B 11/04

[52] U.S. Cl. ..... 187/20; 187/1 R

[58] Field of Search ..... 187/1 R, 20, 21, 1 A, 187/22; 248/49; 267/136, 140.1; 174/42

[56] References Cited

U.S. PATENT DOCUMENTS 1,721,603 7/1929 Neenan ..... 187/20

FOREIGN PATENT DOCUMENTS 773059 3/1934 France ..... 187/20

153462 12/1979 Japan ..... 187/1 R

*Primary Examiner*—H. Grant Skaggs

*Assistant Examiner*—Kenneth Noland

*Attorney, Agent, or Firm*—Robert E. Greenstien

[57] ABSTRACT

In an elevator, a crossbeam or crosshead extends across the top of the car and a thimble rod extends through this beam. The car is suspended on a spring which surrounds the rod and that is located on one side of the beam. Located on the other side of the beam is a block assembly which grasps the rod and a vertical pin that is attached to the beam, for the purpose of providing dampening to the car. A characteristic of this block assembly is that it allows some lost motion, during which there is no dampening, and this has, as an effect, extremely effective noise isolation between the rope and the car, but at the same time substantial dampening—for larger, more undesirable motions by the car.

4 Claims, 2 Drawing Figures

ELEVATOR CAR VIBRATION CONTROL WITH FRICTION DAMPER

TECHNICAL FIELD

This invention relates to car vibration control in an elevator.

BACKGROUND ART

The conventional traction elevator, one supported by one or more cables, usually has the cables directly mounted to the elevator car, usually at a cross-frame that extends across the top of the elevator cab. This, a "hard" connection, is an ideal path for noise transmission to the elevator cab through the ropes from the propulsion system.

Where motor noise or slight but unsuppressible vibrations are present, a direct connection to the elevator car is undesirable, because traditional sound and vibration deadening techniques, which can reduce noise, can also cause a jerky (uneven) ride; hence, they may cure one problem and create another.

DISCLOSURE OF INVENTION

One object of this invention is to provide a technique that is simple and, especially, inexpensive, for attaching the ropes to the cab so that vibration is significantly reduced without adversely affecting elevator ride and cab motion.

According to the present invention, the elevator cables are attached to a rod which extends through the elevator cross-beam. Between the bottom of the rod and the cross-beam there is a spring that provides a resilient, vertical support for the cab. The rod may vertically move within the cross-member, providing an elastomeric sound deadening, mechanical connection between the cab and the rope connected to the rod. The motion is damped, however, by a dampener or brake which is attached to the top of the car. The arrangement applies frictional force to the rod as it moves vertically and dampens oscillatory motion that might otherwise occur due to the spring connection between the cab and the rope.

According to one aspect of the present invention, the dampener has two stages of operation. In one, it allows small motion of the rod with little or no dampening; in the other, it provides greater dampening. This approach significantly reduces small mechanical vibrations, but dampens out large mechanical vibrations that should be avoided to provide a smooth ride.

A particular feature of the invention is that it is extremely inexpensive and simple to install and maintain. Hydraulic damping devices, for example, are far more costly and less reliable, and require routine maintenance (e.g., checking fluid level). Moreover, they are not particularly effective in dampening small vibrations and so would prove ineffective in controlling the small noise and vibration that may be present in recent highly sophisticated elevators.

The following will suggest yet other benefits and features of the invention.

BEST MODE FOR CARRYING OUT THE INVENTION

As mentioned previously, the typical elevator car contains a crosshead or beam that extends across the top of the elevator car. The elevator ropes are attached to this beam and the car is thus suspended from the ropes. Consequently, a complete elevator car is not shown in FIGS. 1 and 2, but rather only a portion of the crosshead 10 and a braking or damping 12 arrangement, which according to the present invention is attached to the crosshead to provide dampening to the motion of the elevator car.

Figure 2:
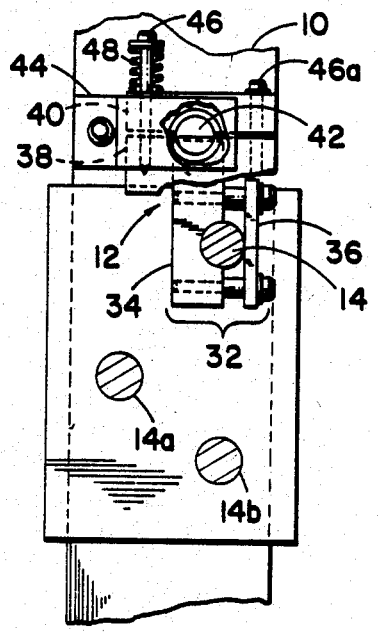
FIG. 2 is a plan view that shows the dampener shown in FIG. 1.
Figure 1:
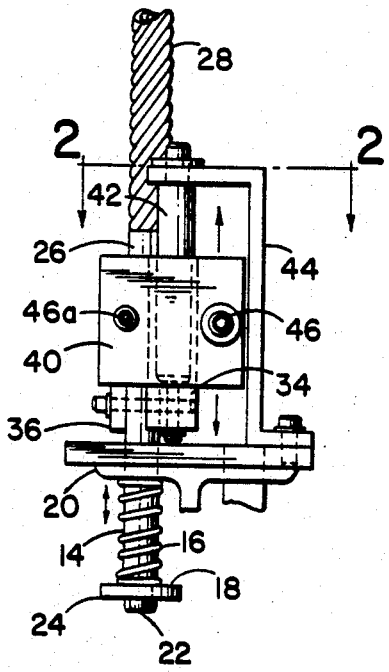
FIG. 1 is an elevational view that partially shows an elevator cross-beam with a rod, spring and the dampener according to the present invention.

FIG. 1 also shows a thimble rod 14 which extends through the crosshead, and, on one side of the crosshead, there is a spring 16 which is compressed between the end of the thimble rod 18 and the bottom and one surface of the crosshead 20. There is a nut 22 and a bolt 24 on the end of the thimble rod. The thimble rod 14 extends through the crosshead, as shown, and one end 26 of it is swaged or otherwise attached to a rope 28 which is used for supporting the car. Referring momentarily to FIG. 2, observe that more than one thimble rod may be utilized; in fact, typically there are more than one, and in this case there are three which are shown as 14, 14*a*, 14*b*. Each of the thimble rods has the previously mentioned spring, and the aggregate of all these spring arrangements provides a resilient, vertical support for the elevator car. Thus, the thimble rods and springs provide highly effective noise dampening.

On the opposite side of the crosshead from the spring is the dampener or brake 12. According to the particular embodiment showing FIGS. 1 and 2, this arrangement includes a block assembly 32 which is clamped to the thimble rod 18. The block assembly first includes a first member 34 and a second member 36 which are tightly squeezed around the thimble rod; thus these two members together move up and down with the thimble rod relative to the crosshead as the car bounces or oscillates slightly on the spring. The dampener 12 also includes third and fourth block members 38,40 which are designed to provide frictional force to this motion. These two block members are squeezed around a vertical pin 42 which is attached by a bracket 44 to the crosshead, thus making the pin stationary relative to the thimble rod and the first, second, third and fourth members. The third and fourth members, however, are squeezed around this vertical pin in a resilient manner by a bolt 46 which passes through the fourth and fifth members by a spring 48. The purpose is to provide frictional loading along the surface of the vertical pin, which, in turn, dampens car motion. The spring 48 holds the third and fourth members of the dampener together and functions to compensate for any wear.

A special feature of this particular embodiment is that the third and fourth members operate to provide dampening only when there is a certain level of vertical motion of the thimble rod, and that is accomplished because only one of the third or fourth members is attached to the first and second members, which are attached to the thimble rod. The diameter of the holes that receive the two bolts 46,46A that hold the third and fourth members together is slightly larger than is required for the bolts so one of the two members can move relative to the other. In this case the fourth member moves relative to the third member as the thimble rod moves up and down. As a result, the braking forces are applied to the pin after there is motion that exceeds the amount allowed by this increased hole diameter. That motion may be characterized as a lost motion, after which there is dampening of the motion of the elevator car. The importance of this two-stage operation is that very small vibrations are not damped out as severely as large vibrations, which must be damped out for a comfortable (nonoscillatory) ride. In other words, by permitting small vibrations, which use the lost motion, to go undamped, noise is very significantly reduced.

In FIG. 2 only one of these dampeners is shown. One or more may be utilized, however, in a system; that depends upon design criteria. Obviously, if more dampeners are used, there will be greater dampening. The braking force applied by each of the third and fourth members in each dampener needs to be tailored to the overall number of brake arrangements that are used in the system. If not, excessive braking force may arise and there will be no noise and vibration dampening through the spring.

The material for the third and fourth members may simply be wood or, preferably, a synthetic material that has high durability and that can withstand rubbing and frictional wear over a long period of time.

The foregoing is a description of the preferred embodiment of the present invention. Certain design variations may have been suggested, but one skilled in the art may, however, and without departing significantly from the true scope and spirit of the invention, develop other modifications and variations to the invention that has been described. For example, if the thimble rod is smooth, the third and fourth members may provide the dampening force directly to the rod (the pin 42 may be omitted in that case) with either being directly mounted to the crosshead.

We claim:

1. An elevator car that comprises a beam across the top of the car for suspending the car from a rope, characterized by:

a thimble rod that extends through the crosshead, one end being attached to the rope;

a compressible spring located between the crosshead and the other end of the thimble rod;

a dampener that is attached to the car for dampening motion of the thimble rod and relative to the beam, comprising: a vertical pin that is attached to the crosshead; a first block member that is attached to the thimble rod and fits partially around the vertical pin in contact therewith; a second block member that fits partially around the vertical pin and mates with the first member; a pair of bolts that hold the first and second members together around the pin and applying pressure thereon to provide resistive force to the vertical movement of the pin.

2. An elevator according to claim 1, characterized in that:

the second block may move vertically relative to the first block member for a small distance and is then held in place by the first member.

3. An elevator according to claim 2, characterized in that:

the bolts extend through holes that are large enough to permit the second block member to move that small distance.

4. An elevator according to claim 3, characterized in that:

one of the bolts extends through a spring which is compressed between one of the block members and one end of the bolt.

* * * * *